US012133573B2

(12) United States Patent
Stoddard

(10) Patent No.: US 12,133,573 B2
(45) Date of Patent: Nov. 5, 2024

(54) SHOE CAPE FOR PROTECTING FOOTWEAR

(71) Applicant: Marlana Rose Stoddard, Taghkanic, NY (US)

(72) Inventor: Marlana Rose Stoddard, Taghkanic, NY (US)

( * ) Notice: Subject to any disclaimer, the term of this patent is extended or adjusted under 35 U.S.C. 154(b) by 0 days.

(21) Appl. No.: 17/839,470

(22) Filed: Jun. 13, 2022

(65) Prior Publication Data

US 2023/0397691 A1 Dec. 14, 2023

Related U.S. Application Data

(63) Continuation of application No. 16/350,901, filed on Jan. 31, 2019, now abandoned.

(51) Int. Cl.
*A43B 3/16* (2022.01)
*A43B 3/18* (2022.01)

(52) U.S. Cl.
CPC . *A43B 3/16* (2013.01); *A43B 3/18* (2013.01)

(58) Field of Classification Search
CPC .. A43B 3/16; A43B 3/18; A43B 3/166; A43B 3/20; A43B 5/18
USPC ..... 36/7.2, 7.4, 7.7, 1.5, 2 R
See application file for complete search history.

(56) References Cited

U.S. PATENT DOCUMENTS 1,930,748 A * 10/1933 Giorda ..... A41D 1/06 2/82
2,053,813 A * 9/1936 Brennan ..... A41D 17/00 36/1.5
2,145,061 A * 1/1939 Stuart ..... A43B 3/20 36/2 R
2,420,618 A * 5/1947 Rabinovitz ..... A43B 3/16 36/72 R
2,625,752 A * 1/1953 Kemp ..... A43B 3/20 36/72 R
RE28,236 E * 11/1974 Hendricks ..... A43B 13/04 36/87
3,875,687 A * 4/1975 Henderson ..... A43B 3/16 36/7.1 R
3,949,493 A * 4/1976 Rhee ..... A43B 5/00 36/2 R
4,094,080 A * 6/1978 Sanders ..... A43B 7/02 36/2.6
4,168,584 A * 9/1979 Wren, Jr. ..... A43B 5/18 36/114
4,461,098 A * 7/1984 Diegelman ..... A43B 3/16 2/919
4,665,633 A * 5/1987 Edgerton ..... A43B 3/16 36/7.1 R
5,251,386 A * 10/1993 Diaz ..... A43B 3/16 36/1.5
5,787,607 A * 8/1998 Schurch ..... A43B 23/06 36/7.1 R
5,845,416 A * 12/1998 Hands ..... A43B 3/16 36/105

(Continued)

*Primary Examiner* — Ted Kavanaugh
(74) *Attorney, Agent, or Firm* — Eric M. Bram

(57) ABSTRACT

A shoe cape provides a durable, washable material base to cover footwear in environments where there is debris that may otherwise fall into the footwear and cause damage to the footwear and irritation and other damage to the wearer's leg. Such environments include many factories and also barbershops.

1 Claim, 4 Drawing Sheets

(56) References Cited

U.S. PATENT DOCUMENTS

| | | | | |
|---|---|---|---|---|
| 5,956,867 | A * | 9/1999 | Harton | A43B 7/34 36/7.1 R |
| 5,987,778 | A * | 11/1999 | Stoner | A43B 7/32 36/109 |
| 2005/0066551 | A1* | 3/2005 | Evans | A43B 3/16 36/131 |
| 2014/0215851 | A1* | 8/2014 | Solsona | A43B 9/02 36/84 |
| 2017/0273391 | A1* | 9/2017 | Emmanuelli | A43B 3/18 |
| 2018/0303193 | A1* | 10/2018 | Weaver | A43B 13/22 |
| 2020/0359733 | A1* | 11/2020 | Linas | A43B 3/166 |
| 2021/0386156 | A1* | 12/2021 | Stoddard | A43B 3/18 |

* cited by examiner

SHOE CAPE FOR PROTECTING FOOTWEAR

CROSS-REFERENCE TO RELATED APPLICATIONS

This application is a continuing application claiming priority and benefit of U.S. application Ser. No. 16/350,901 filed 31 Jan. 2019.

BACKGROUND AND SUMMARY

A cape is envisioned for footwear (a sneaker or shoe, for example) protection and cleanliness, and for protection of the user's skin from any particles which exist in our daily tasks and in many professions. For example, in the barbershop and hairdressing profession, small hair particles, which can turn into hair splinters that could come into contact with a hairstylist/barber's ankles and feet and cause discomfort and/or infection.

In the matter of terminology, the term "shoe" is used herein below, in both the specification and the claims, to refer to any kind of footwear a user may be wearing on his foot, including but not limited to a shoe, sneaker, slipper, boot, sandal, or sock. Also, directional terms like up, down, above, below, front, rear, and back, etc., are used in the normal sense a person standing up would use them.

For example, "downward" and "below" refer to the approximate direction an object will normally be accelerated if dropped by the person, while "up" and "above" to the approximate opposite direction. Likewise, "falling" refers to motion of an unsecured object in the downward direction, as it would normally be comprehended by a person.

Additionally, the "front" of the shoe cape and the shoe refer to the approximate direction and side of the shoe cape and the shoe farthest in the direction in which the toe of the shoe would normally be pointing, and "rear" refers to the direction and side of the shoe cape and the shoe approximately opposite that direction, again as would normally be comprehended by a person when hearing those terms.

The cape may preferably be designed with simplicity in mind. Quick application of the cape in some embodiments could begin by securing the cape at the top of the ankle, for example my lining it with elastic using, for instance, a breathable nylon or other suitable material, and comfortably securing the cape around the user's ankle using one of many possible types of securing configurations including straps, clasps, buckles, ties, etc.

An elastic strap could, for example, be threaded through the top of the cape with a tab sticking out at one end and one or preferably at least two D-rings or O-rings held by a loop sewn into or onto the strap or the exterior of the top of the cape through or along which the tab of the elastic strap could be threaded in a way that is done for comfort and security of the wea020rer. Other types of embodiments are possible, as discussed below for instance.

The breathable nylon or other material may extend such that it covers the full shoe to the bottom base and is bordered around the whole cape with non-slip or other suitable material for safety and grip. Located inside of the non-slip material may be a pocket (inner layer of material) where parachute or another suitable type of may be lined (threaded) through the length of the cape to make the string glide with ease when tightening so as to fit firmly around the shoe. Once the cape is applied to the wearer's ankle, the string could be adjusted for size using a spring chord toggle stopper, or tied, as the user desires. Other embodiments of the Cape may cover and wrap around the entire shoe for complete coverage, offering protection from contaminants such as hair dye and splinters, as previously discussed, and facilitating overall shoe cleanliness. Other benefits of the cape may include protecting and preserving the structure and life of the shoe, thus providing a cost benefit to the user.

Accordingly, in one possible embodiment of the invention A shoe cape includes a durable, washable material base capable of sufficiently covering a shoe to keep particles and/or other residue from falling into the shoe when the shoe cape is being worn above the shoe. The base is configured so when not being worn it can lie essentially flat on a flat surface, in which unfolded position it presents a convex U-shaped outer edge, a concave U-shaped inner edge, and first and second straight edges collinear with each other but with a gap between them, such that each of the first and second straight edges connects the convex edge with the concave edge. The base is also configured such that when the shoe cape is being worn above the shoe the first and second flat edges meet at the back of the shoe cape, the convex U-shaped outer edge forms the bottom edge of the shoe cape, and the convex U-shaped outer edge forms the top of the shoe cape. The convex edge is appreciably larger than said concave edge, so when worn above the shoe the bottom edge of the shoe cape extends farther forward than the top edge to cover the entire shoe. A nonslip material covers the convex U-shaped edge. An elastic band is affixed with two D rings. The elastic band is located at a height above the shoe such that when worn, the shoe cape is secured above and covers the entire shoe to protect the shoe while providing a comfortable fit. There are at least two grommets and a pull string that can be threaded through the shoe cape, passing through each of the grommets.

BRIEF DESCRIPTION OF THE DRAWING FIGURES

DETAILED DESCRIPTION

Figure 2:
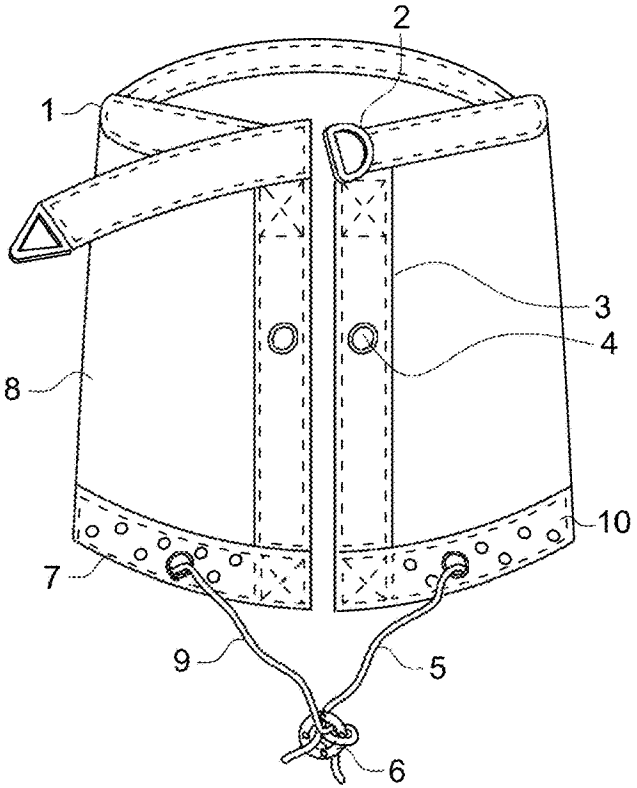
FIG. 2 is a rear view of the shoe cape being worn in accordance with the embodiment of FIG. 1.
Figure 1:
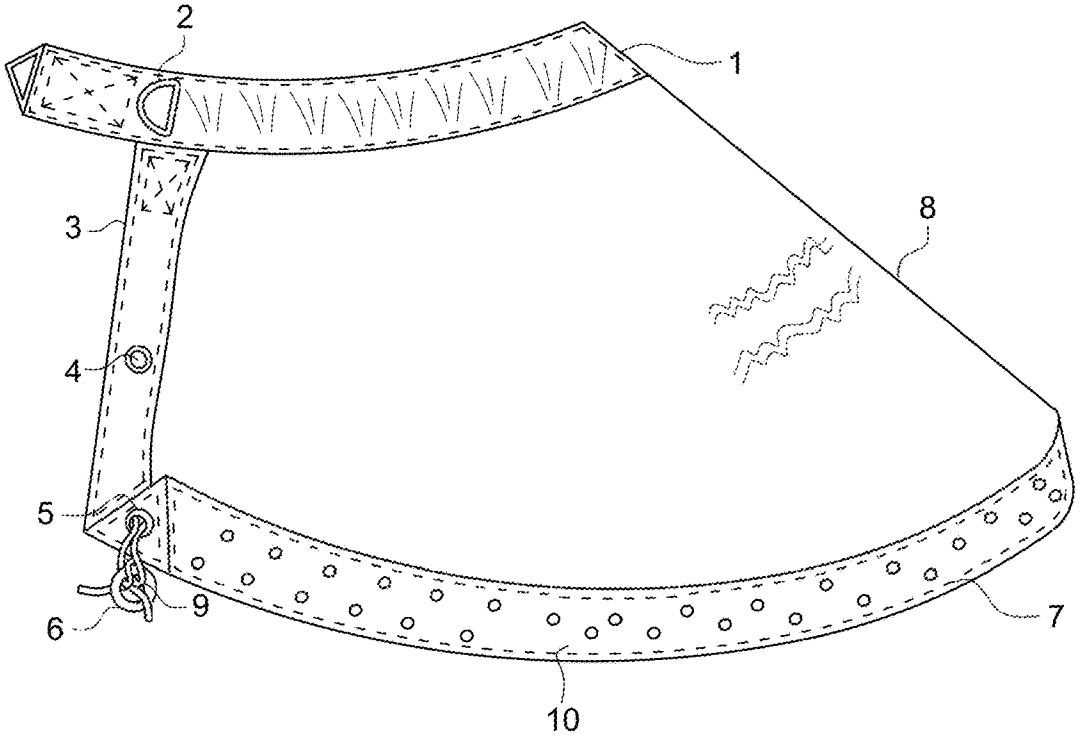
FIG. 1 is a side view of a protective shoe cape being worn in accordance with one possible embodiment of this invention.

One or more possible embodiments of the invention wilt now be described with reference to the drawing figures. To facilitate understanding by the reader, a detailed description of FIG. 4 will be given first.

Figure 4:
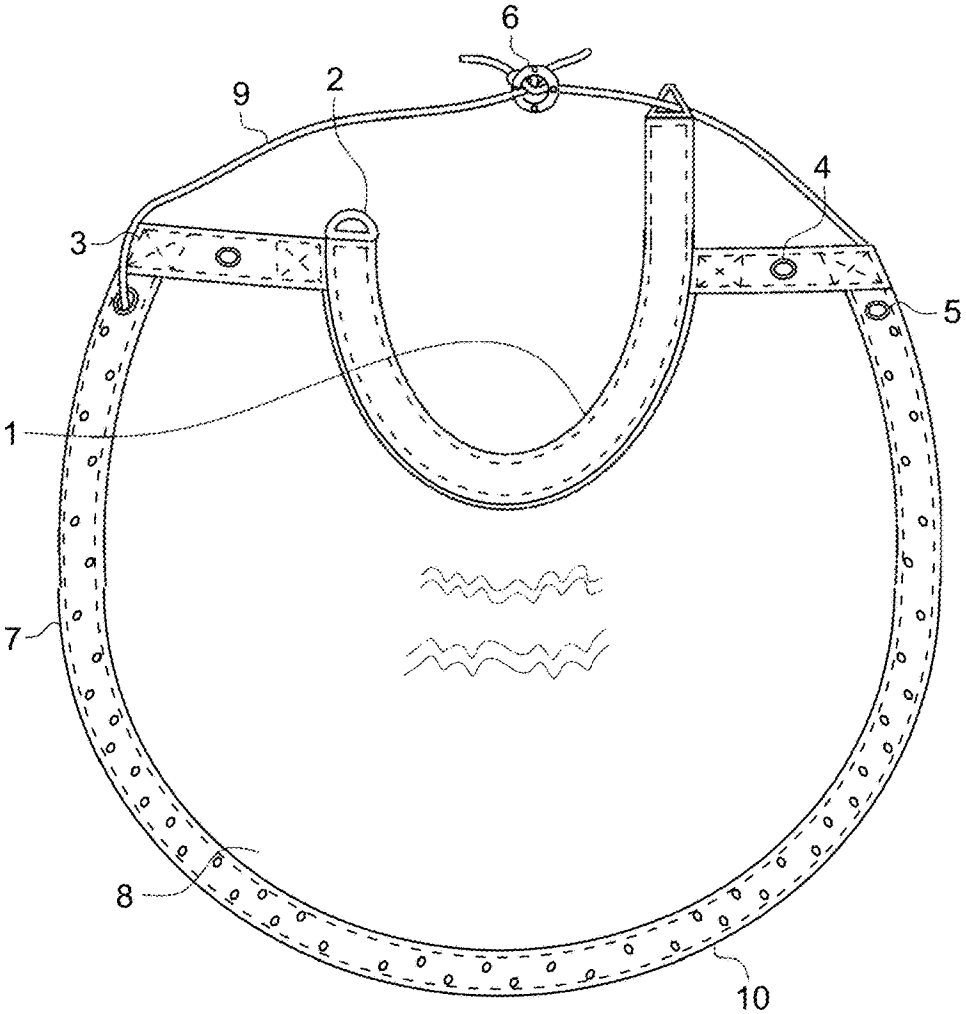
Figure 3:
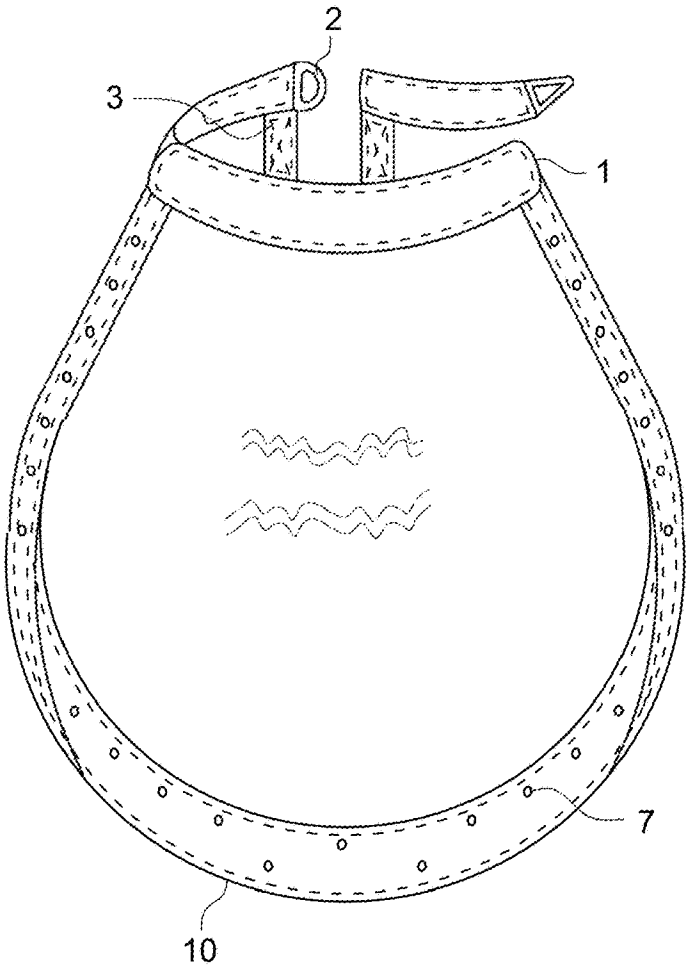
FIG. 3 is a front view of the shoe cape being worn in accordance with the embodiment of FIGS. 1 and 2.
Figure 6:
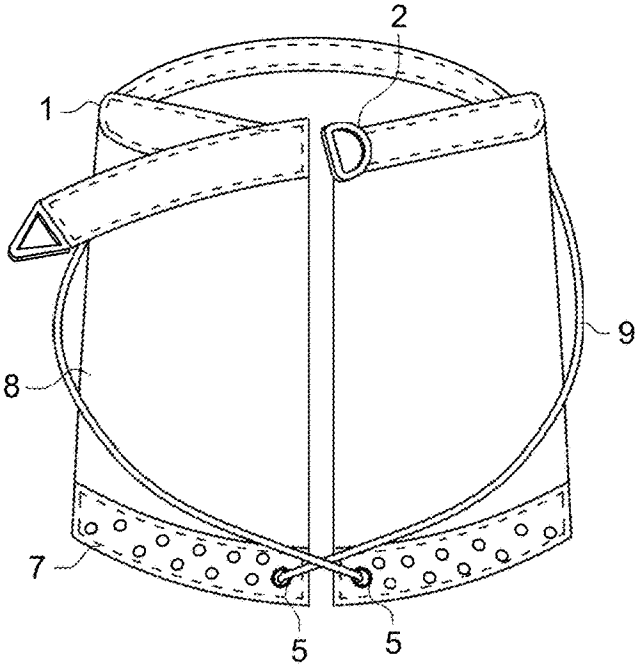
FIGS. 5-8 are similar views to FIGS. 1-4, respectively, but of another possible embodiment.

With reference to FIG. 4, a base 8 may comprise a durable, washable material, shown in FIG. 4 in an unfolded position lying essentially flat on a flat surface (not shown) under the base 8. The base 8 has a convex U-shaped outer edge 10 and a concave U-shaped inner edge 1. The convex outer edge 10 of the base 8 is longer than the convex inner edge 1 of the base 8.

The convex outer edge 10 and the concave inner edge 1 may be connected at or near first respective ends 21, 22 by a first straight edge 3*a*, and at or near second respective ends 23, 24 by a second straight edge 3*b*. The first and second straight edges 3*a*, 3*b* are substantially collinear when the base 8 is unfolded and lying flat as shown in FIG. 4.

Respective halves of a snap 4*a*, 4*b* may be respectively placed in the first and second straight edges 3*a*, 3*b*.

The convex outer edge 10 may be covered by a nonslip material 7. The concave inner edge 1 of the base 8 may be sewn around an elastic band 25 that may span the entire length of the concave inner edge 1. A number of D rings or O-rings 2 may be secured at the first end 22 of the concave edge. An extension 27 of the elastic band 25 and concave edge 1 may extend past the place where the second end of the concave edge at the place 24 where it meets the second straight edge 3*b*.

A pull string 9 may be threaded through the convex U-shaped edge 10 and pass through grommets 5*a*, 5*b*. A spring chord toggle stopper 6 may be optionally placed along the pull string 9.

With reference to FIGS. 1-3 and 8-10, these reviews show the embodiments of FIGS. 4 and 11 as they would appear no longer flat but in use. The concave U-shaped inner edge 1 is now the upper edge of the shoe cape, the convex U-shaped outer edge 7 is now the bottom edge of the shoe cape, and the first and second straight edges 3*a*, 3*b* now newly or fully meet at the back of the shoe cape and are now substantially parallel instead of substantially collinear.

In the drawings can be seen that a tab section of the concave inner edge 1, which in his view is the upper edge of the shoe cape, extends past the second straight edge 3*b*.

Figure 5:
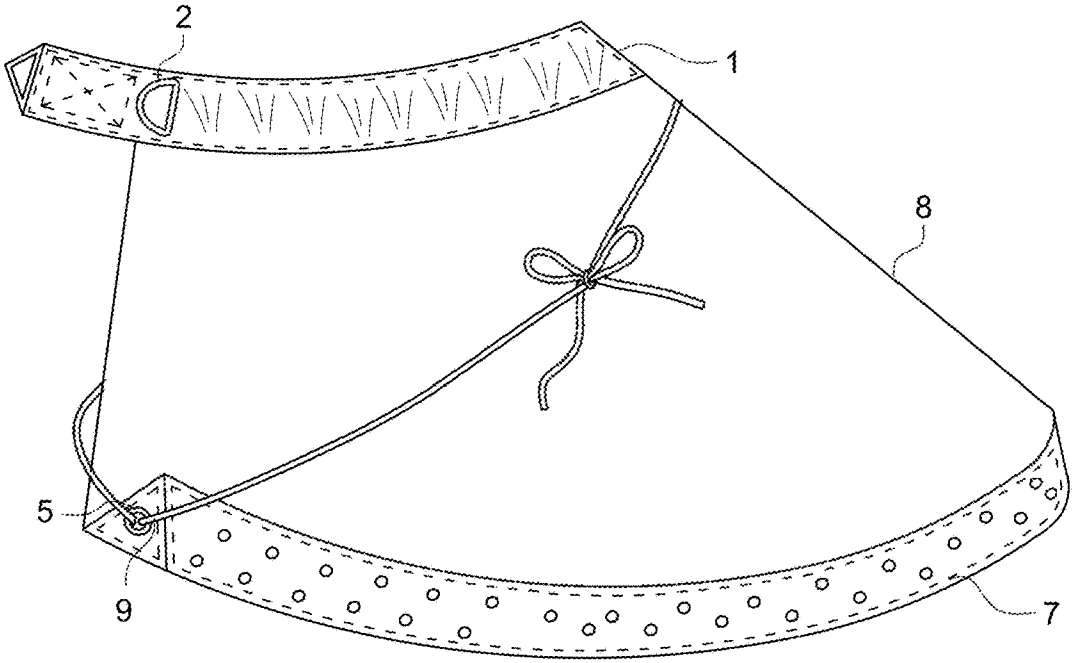

The embodiment of FIGS. 5-8 differs from that of FIGS. 1-4, for example instead of a toggle stopper 6, the pull string 9 is threaded through the grommets in the back (see FIG. 6) and is tied in front (FIG. 5). Also, the snap 4 is not used in this embodiment. Additionally, material is not added on the inside of the nonslip material 10 in this embodiment.

Figure 8:
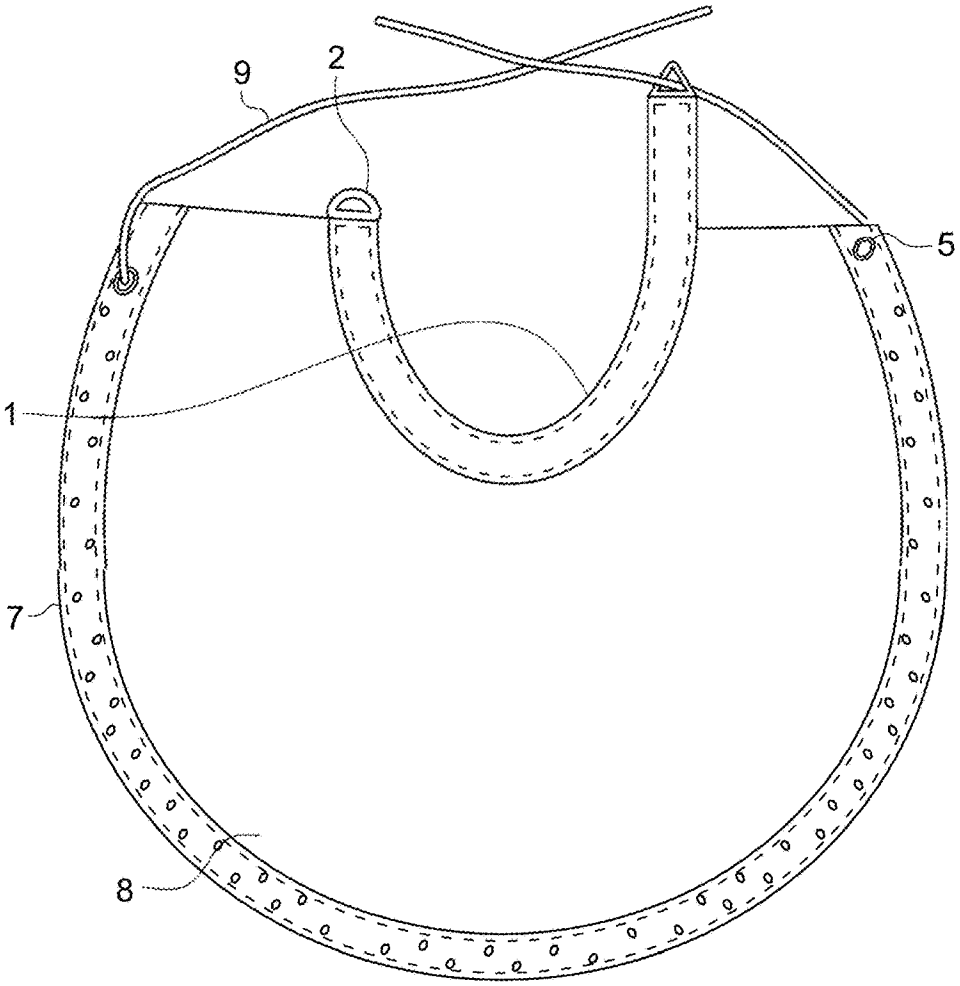
Figure 7:
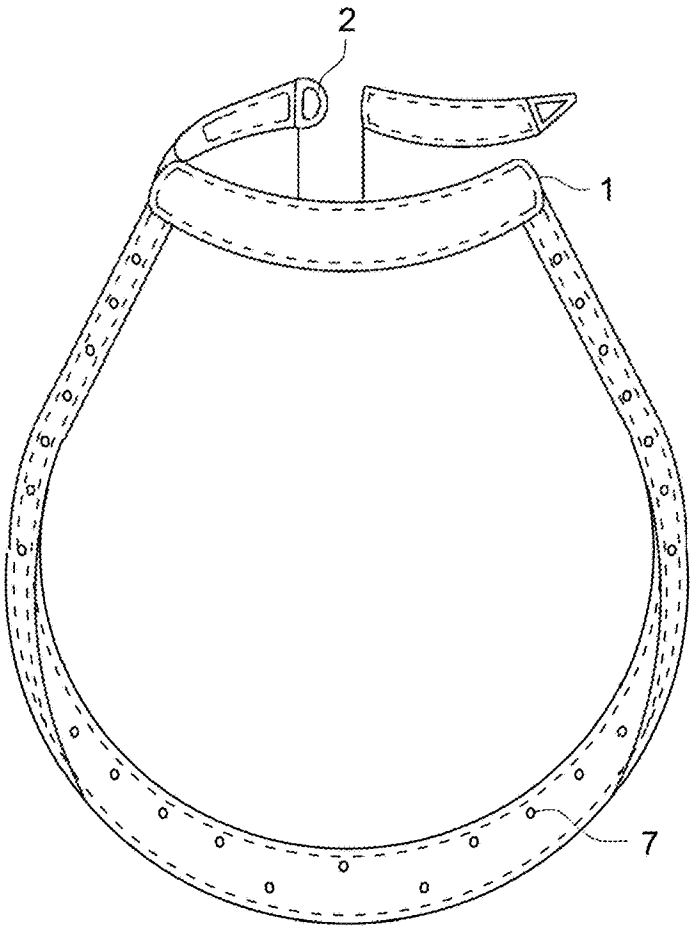

The embodiments of FIGS. 8-11 differs from that of FIGS. 1-4, for example instead of a toggle stopper 6, the pull string 9 is threaded through the grommets in the back (see FIG. 9) and is tied in front (FIG. 8). Also, the snap 4 is not used in this embodiment. Additionally, material is not added on the inside of the nonslip material 10 in this embodiment.

COMMERCIAL APPLICABILITY

The shoe cape is made with breathable nylon material. The material can vary for personal or professional use. Starting at the top of the ankle, the top edge may have elastic sewn into the breathable nylon material, and may be secured in place with a hem stitch. Metal D-rings (O-rings are also possible) made of a suitable material like metal on one side can be used to adjust the length around the ankle. The breathable nylon material may then expand freely, designed with the look of a draped cape covering the shoe. At the bottom of the shoe cape, which covers the entire shoe and may even wrap a bit around the bottom, depending on how tightly the user ties the pull string 9, the non-slip material 10 may be placed for safety and grip so that the user does not slip on the floor when wearing the shoe cape. The grommets at the base of the shoe cape, where the parachute string enters and exits, may direct and reinforce the exit of the pull string, whose length and material may vary (string can vary). At the back of the two edges meet and vertically align, reaching to the top of the edge where the elastic is set in place.

This shoe cape may provide protection in all varieties of industries that involve excessive exposure of debris, and maybe made to be washable. A great savings on having to purchase new footwear is thus possible.

It should be understood, of course, that the foregoing relates to exemplary embodiments of the invention and that modifications may be made without departing from the spirit and scope of the invention as set forth in the following claims.

I claim:

1. A shoe cape comprising:

a durable, washable material base capable of sufficiently covering a shoe to keep particles and/or other residue from falling into the shoe when the shoe cape is being worn above the shoe, said base being configured so when not being worn it can lie essentially flat on a flat surface, in which unfolded position it presents a convex U-shaped outer edge, a concave U-shaped inner edge, and first and second straight edges collinear with each other but with a gap between them, such that each of the first and second straight edges connects the convex edge with the concave edge;

said base further being configured such that when the shoe cape is being worn above the shoe: said first and second flat edges meet at the back of the shoe cape, said convex U-shaped outer edge forms the bottom edge of the shoe cape, and said concave U-shaped inner edge forms the top of the shoe cape, said convex edge being appreciably larger than said concave edge, such that when worn above the shoe the bottom edge of the shoe cape extends farther forward than the top edge to cover the entire shoe;

a nonslip material covering the convex U-shaped edge;

an elastic band affixed with two D rings, the elastic band located at a height above the shoe such that when worn, the shoe cape is secured above and covers the entire shoe to protect the shoe while providing a comfortable fit;

at least two grommets; and a pull string threaded or able to be threaded through the convex U-shaped edge, each end of said pull string exiting or able to exit through a respective one of the grommets, such that the pull string can be pulled to tighten the shoe cape around the shoe and cover at least the exposed portion of the shoe.

* * * * *